US006935501B2

(12) United States Patent
Gerulski et al.

(10) Patent No.: US 6,935,501 B2
(45) Date of Patent: Aug. 30, 2005

(54) WOUND FILM DISPENSER WITH EXTERIOR RETAINER AND METHOD OF MANUFACTURING SAME

(75) Inventors: Kristopher W. Gerulski, County of Racine, WI (US); Alan John Linder, County of Waukesha, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 105 days.

(21) Appl. No.: 09/993,309

(22) Filed: Nov. 16, 2001

(65) Prior Publication Data

US 2002/0117530 A1 Aug. 29, 2002

Related U.S. Application Data

(63) Continuation-in-part of application No. 09/711,017, filed on Nov. 13, 2000, now Pat. No. 6,564,942.

(51) Int. Cl.[7] ..... B65D 85/672
(52) U.S. Cl. ..... 206/396; 225/47
(58) Field of Search ..... 206/396, 408, 206/397; 225/46, 47, 48, 49; D9/433

(56) References Cited

U.S. PATENT DOCUMENTS

| | | | | |
|---|---|---|---|---|
| 1,076,635 | A | | 10/1913 | Howard |
| 1,082,964 | A | | 12/1913 | Macdonald |
| 1,691,995 | A | | 11/1928 | Saulter |
| 1,907,922 | A | | 5/1933 | Willis |
| 2,330,117 | A | | 9/1943 | Feinberg et al. |
| 2,458,844 | A | | 1/1949 | Foote |
| 2,472,521 | A | | 6/1949 | Danenbauer |
| 2,507,403 | A | | 5/1950 | Gluck |
| 2,624,521 | A | | 1/1953 | Broeren |
| 2,743,009 | A | | 4/1956 | Williamson et al. |
| 2,748,931 | A | | 6/1956 | Taylor |
| 2,799,393 | A | | 7/1957 | Klein |
| 2,803,339 | A | | 8/1957 | Kuchenbecker |
| 2,853,185 | A | | 9/1958 | Rollie |
| 2,864,493 | A | | 12/1958 | Holcombe |
| 3,121,542 | A | | 2/1964 | Van Dyke et al. |
| 3,128,025 | A | | 4/1964 | Buttery et al. |
| 3,159,323 | A | | 12/1964 | Hawk |
| 3,166,187 | A | | 1/1965 | Araujo |
| 3,228,519 | A | | 1/1966 | Dong et al. |
| 3,229,812 | A | * | 1/1966 | Metzger ..... 206/396 |
| 3,246,742 | A | | 4/1966 | Coe |
| 3,262,620 | A | | 7/1966 | Burt et al. |
| 3,458,109 | A | | 7/1969 | Compton et al. |
| 3,477,624 | A | | 11/1969 | Branyon et al. |
| 3,530,980 | A | | 9/1970 | Link |

(Continued)

FOREIGN PATENT DOCUMENTS

WO WO 03/106121 A1 12/2003

*Primary Examiner*—Kenneth E. Peterson

(57) ABSTRACT

A wound film dispenser with exterior retainer and method of assembling same are disclosed. The wound film dispenser includes a base to which a lid is hingedly attached via a fold. The interior end walls of the base include false walls which are biased into the base. The false walls include aperture through which the ends of the roll extend to at least partially receive the ends of the roll of wound film material. In so doing, the retainers are provided exterior to the roll of film. The false walls may be biased into the base using braces pushing the top edge of the false wall away from the end walls.

8 Claims, 6 Drawing Sheets

U.S. PATENT DOCUMENTS

| | | | | |
|---|---|---|---|---|
| 3,587,840 | A | | 6/1971 | Hultberg |
| 3,613,973 | A | | 10/1971 | Jaeschke |
| 3,685,644 | A | | 8/1972 | Cothran et al. |
| 3,698,548 | A | | 10/1972 | Stenzel et al. |
| D232,081 | S | | 7/1974 | Zine, Jr. |
| 4,062,447 | A | | 12/1977 | Gardner |
| 4,151,914 | A | | 5/1979 | Blatt |
| 4,238,065 | A | | 12/1980 | Ragsdale |
| 4,298,123 | A | | 11/1981 | Roccaforte |
| D267,544 | S | | 1/1983 | Neto et al. |
| 4,373,687 | A | | 2/1983 | Zicko |
| 4,667,824 | A | | 5/1987 | Ditchfield |
| 4,715,519 | A | | 12/1987 | Fischer |
| 4,813,539 | A | | 3/1989 | Church et al. |
| 4,925,028 | A | | 5/1990 | Smith |
| D313,752 | S | | 1/1991 | Dyble |
| 4,998,656 | A | | 3/1991 | Hurh |
| D325,311 | S | | 4/1992 | Mygind |
| 5,121,839 | A | | 6/1992 | Lapp |
| 5,141,108 | A | | 8/1992 | Roccaforte |
| 5,449,070 | A | | 9/1995 | Broderick |
| 5,484,082 | A | | 1/1996 | Casper et al. |
| 5,511,663 | A | | 4/1996 | Shimura et al. |
| D372,387 | S | | 8/1996 | Kuchenbecker |
| D383,934 | S | | 9/1997 | McNaughton |
| 5,662,758 | A | | 9/1997 | Hamilton et al. |
| D395,823 | S | | 7/1998 | Durand |
| 5,871,607 | A | | 2/1999 | Hamilton et al. |
| D414,061 | S | | 9/1999 | Peachey |
| 5,971,150 | A | | 10/1999 | Anderson et al. |
| 6,564,942 | B1 | * | 5/2003 | Shiffler et al. ..... 206/395 |
| 6,612,473 | B1 | | 9/2003 | Newby et al. |

* cited by examiner

WOUND FILM DISPENSER WITH EXTERIOR RETAINER AND METHOD OF MANUFACTURING SAME

CROSS-REFERENCE TO RELATED APPLICATION

This application is a continuation-in-part of U.S. patent application Ser. No. 09/711,017, filed on Nov. 13, 2000 now U.S. Pat. No. 6,564,942.

FIELD OF THE INVENTION

The invention generally relates to dispensers and, more particularly, relates to dispensers for use in conjunction with wound films such as plastic wrap, aluminum foil, wax paper, and the like.

BACKGROUND OF THE INVENTION

Cartons for the storage and dispersal of rolls of wound flexible film are well-known. Such cartons are typically manufactured from paperboard material and are folded into a configuration conventionally referred to as a trunk-lid box wherein a base or box of the carton forms an enclosure for the roll with an open top, and the lid is folded relative to the trunk at a natural hinge to thereby allow the lid to close the trunk.

A number of criteria need to be considered when manufacturing such a carton. One concern is the ease with which the material can be drawn from the roll. This criteria is a function of a number of variables including the type of material wound onto the roll, the manner in which the roll is positioned or placed within the carton, and the angle at which the material must be pulled from the carton. For example, if the material is highly adhesive in nature, it may tend to adhere to itself thereby requiring a relatively high level of force to pull the material from the roll. Depending upon the degree of tack of the film, and the angle at which the material is pulled from the carton, the roll itself may tend to be pulled completely out of the carton, creating a source of frustration for the user. Morever, once the roll is pulled from the carton, the risk of contamination of the film is increased.

Mechanisms have therefore been devised which perform a retention feature within the carton. In other words, the roll itself may be physically held within the carton such that upon a user pulling on the film, the roll is held against the force created by the user, while still enabling the roll to rotate and thereby dispense film. For example, U.S. Pat. No. 4,998,656, assigned to the present assignee, discloses a roll restraining dispensing carton wherein the opposite ends of the carton include collars for retaining the roll within the carton. The collars include apertures which circumnavigate the ends of the roll to thereby physically hold the roll within the carton, and also provide a bearing surface around which the roll may rotate.

While such cartons have proven to be successful, it would be advantageous to continue to improve roll retention and dispensing capabilities. Moreover, since such cartons are typically manufactured and loaded with rolls of wound film in an automated process, it would be advantageous to improve the ease with which the carton is manufactured as well.

SUMMARY OF THE INVENTION

In accordance with one aspect of the invention, a wound film dispenser is provided which comprises a base, a lid, and retention walls. The base includes bottom, left, right, front, and back walls, and an open top defining an interior channel. The lid is hingedly attached to the base. The retention walls are mounted in the first and second ends of the base and each include an aperture adapted to receive an end of the roll of wound film. The retention walls are each non-parallel to the end walls.

In accordance with another aspect of the invention, a wound film dispenser is provided which comprises a base, a cover hinged to the base, a roll of wound film within the base, and means for retaining the roll within the base. The means includes false walls biased into the base.

In accordance with another aspect of the invention, a method of assembling a wound film dispenser is provided comprising the steps of folding a section of die-cut material into a tube, inserting a roll of wound film into the tube, folding false walls into the tube, and folding at least one flap against each of the false walls. The tube includes first and second open ends, a top surface, a bottom surface, a front surface, and a back surface.

The false walls include apertures receiving ends of the wall, as well as braces engaging the flaps and biasing the false walls into the tube.

These and other aspects and features of the invention will become more apparent upon reading the following detailed description when taken in conjunction with the accompanying drawings.

Figure 1:
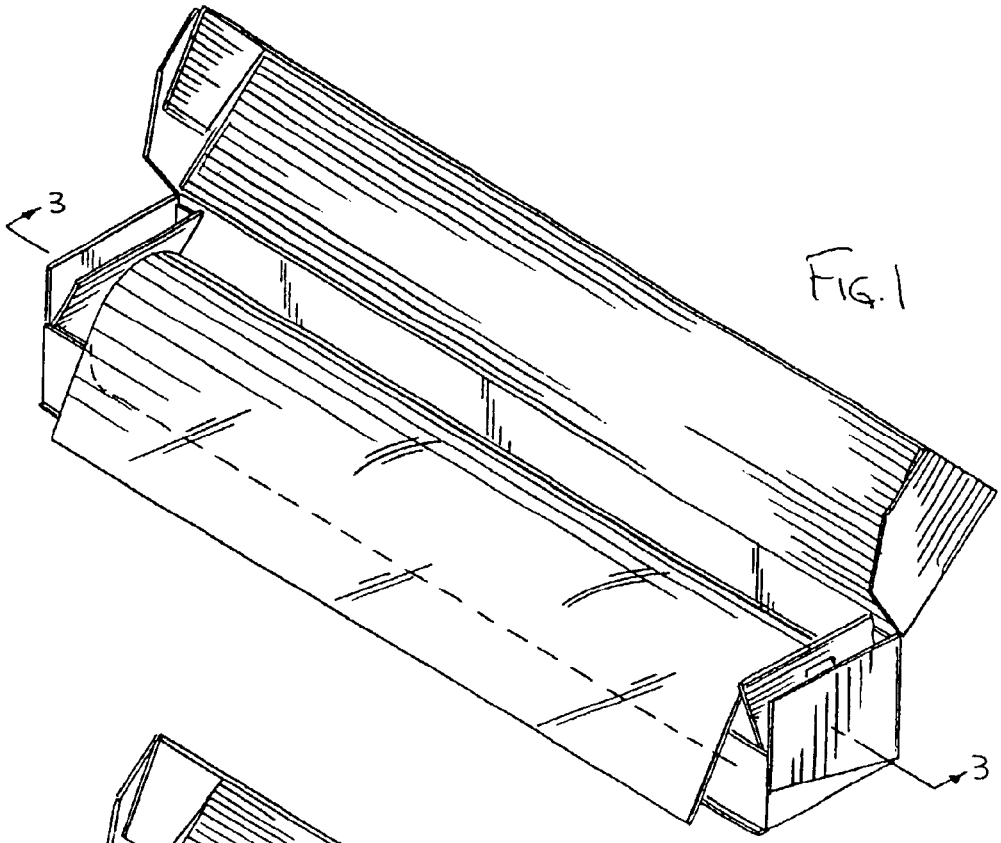
FIG. 1 is an isometric view of a wound film dispenser constructed in accordance with the teachings of the invention, with a roll of wound film held therein.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENTS

Referring now to the drawings, and with specific reference to FIG. 1, a film dispenser constructed in accordance with the teachings of the invention is generally depicted by reference numeral 20. As shown therein, the film dispenser 20 includes a base 22 to which a lid 24 is naturally hinged at a fold 26. The base 22 defines an interior channel 28 in which a roll 30 of wound web material 32 is positioned. In the preferred embodiment, the base 22 and lid 24 are manufactured from an integral piece of material such as paperboard, chipboard, cardboard, corrugated board, microfluted board, or the like, and is folded and joined in a series of consecutive steps as will be described in further detail herein to form the film dispenser 20. In one preferred embodiment, the material may be provided in the form of twenty-four point single ply chipboard, but other materials, including chipboard having a lesser point count, are certainly possible.

With reference now to FIGS. 2–5, the carton 20 is depicted both with and without a roll 30 provided therein. The base 22 includes a bottom wall 34, a front wall 36, a back wall 38 and first and second ends 40, 42. The lid 24 includes a top wall 44, a front wall 46, and first and second ends 48, 50. The roll 30 includes a core 52 (FIG. 3) around which is wound the web of film 32. Film 32 may be, but is not limited to plastic wrap, aluminum foil, wax paper and the like. A cutter bar 43 may be provided anywhere on dispenser 20 for severing wrap 32, such as on bottom wall 34, or preferably on an inside surface of the lid front wall 46.

Figure 3:
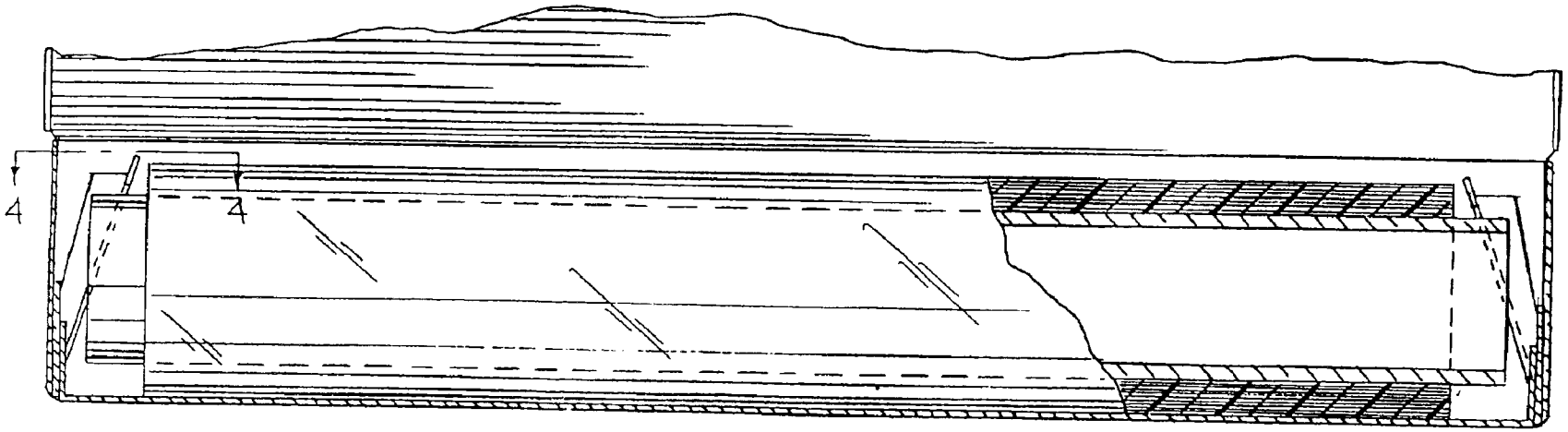
FIG. 3 is a longitudinal sectional view of the film dispenser of FIG. 1 taken along line 3—3 of FIG. 1 with the roll of film shown in partially cut-away form.
Figure 4:
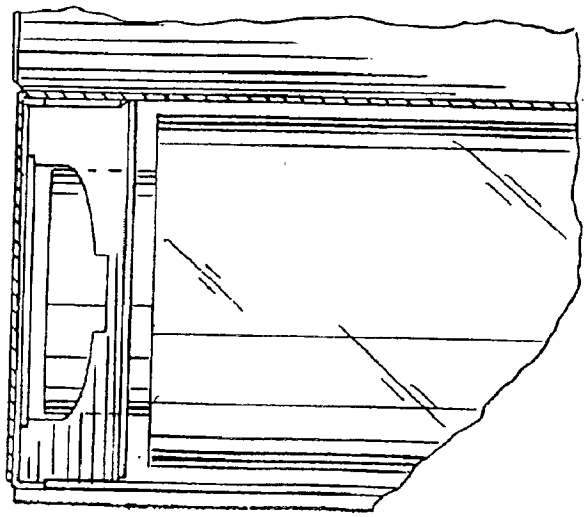
FIG. 4 is an enlarged cut-away top view of the dispenser of FIG. 1.

As shown in FIGS. 3 and 4, each of the ends 40, 42 of the base 22 includes a retainer 56 adapted to retain the roll 30 within the dispenser 20. More specifically, the retainers 56 at least partially surround first and second ends 58, 60 of the core 52 to physically hold the roll 30 in the dispenser 20. The retainers 56 do so with, among other things, reduced material requirements as compared to prior dispensers.

In one embodiment, the retainer 56 may be provided in the form of a false wall 62 angled into the interior channel 28. FIG. 3 indicates that the false wall 62 is biased into the interior channel 28 at an angle $\infty$ relative to the ends 40, 42, but it is to be understood that alternative embodiments may angle the false wall 62 differently, or from different surfaces within the dispenser 20 including, but not limited to, the back wall 38.

In the depicted embodiment, the false wall 62 extends from a base section 63 (FIG. 5) hinged to the bottom wall 34 of the base 22 and is angularly biased inwardly by a brace 64. The brace 64 extends from a back edge 66 of the false wall 62. The brace 64 is substantially wedge-shaped including a top edge 68, a tapered side edge 70 and a straight edge 72. While the brace 64 is indicated to be proximate the back wall 38, it is to be understood that in alternative embodiments, the brace 64 could be provided, for example, proximate the front wall 36 as well. The brace 64 is preferably not adhered to the back wall 38, but rather relies on the outward bias afforded by the roll 30, forcing the straight edge 72 into engagement with the first and second ends 40, 42 of the base 22. Given the angle of the tapered edge 66, the false wall 62 is angled in an identical fashion. In alternative embodiments, the brace 64 and/or false wall 62 may be adhered into an angled position.

Figure 5:
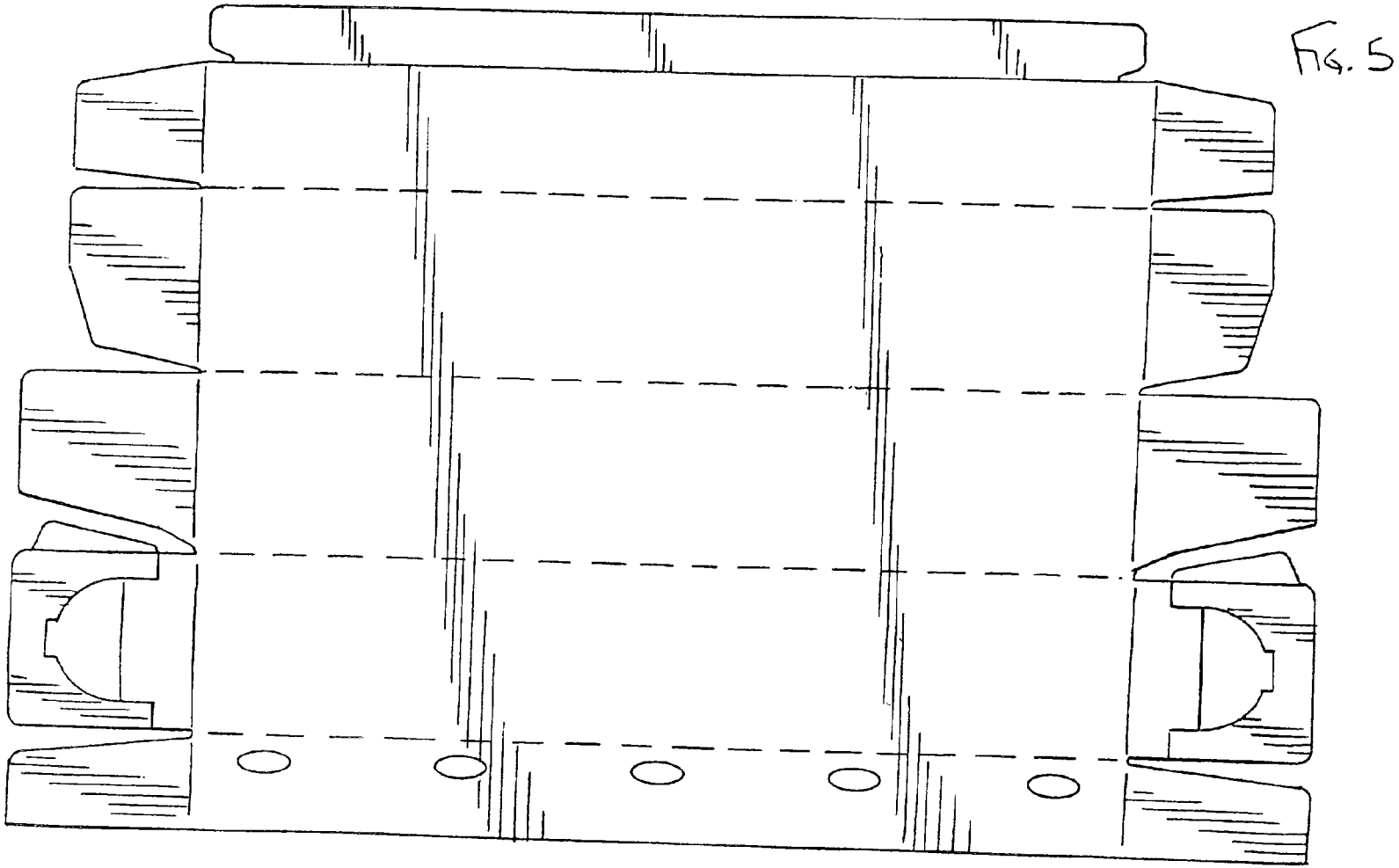
FIG. 5 is a plan view of a die-cut blank prior to folding according to the teachings of the invention.

As shown best in FIGS. 4 and 5, the false wall 62 further includes an aperture 76. In the depicted embodiment, the aperture 76 is substantially semi-circular in shape and is adapted to receive the first and second ends 58, 60 of the core 52. As shown in FIG. 3, the apertures 76 do not receive the entire ends 58 and 60 of the core 52, but rather only partially receive the core 52 therethrough. Alternatively, if the false walls 62 and/or dispenser 20 are enlarged, and the core 52 lengthened, the ends 58, 60 may be entirely received within the false walls 62.

FIG. 4 further depicts the multiple end flaps of the dispenser 20 completing the end walls 40, 42. With regard to the base 22, a major flap 80 extends from each end of the back wall 38, while a minor flap 82 extends from each end of the front wall 36. It is to be understood that the major and minor flaps 80, 82 may be attached to opposite walls, may be provided in opposite dimension, or may be provided in similar dimension. Similarly, with respect to the lid 24, a major flap 84 extends from each end of the top wall 44, while a minor flap 86 extends from each end of the front wall 46.

Completing the sections of the dispenser 20, it will be noted that a tear strip 88 is attached along a score line 90 to an outer edge 92 of the lid front wall 46. As will be discussed in further detail herein, during assembly the dispenser 20 is formed by folding a blank 94 (FIG. 5) into a tube and securing the tear strip 88 to the trunk front wall 36. Adhesive may be applied to plurality of scored areas 96 to not only secure the dispenser 20, but facilitate removal of the tear strip 88 when desired without defacing the remainder of the dispenser 20.

Figure 6:
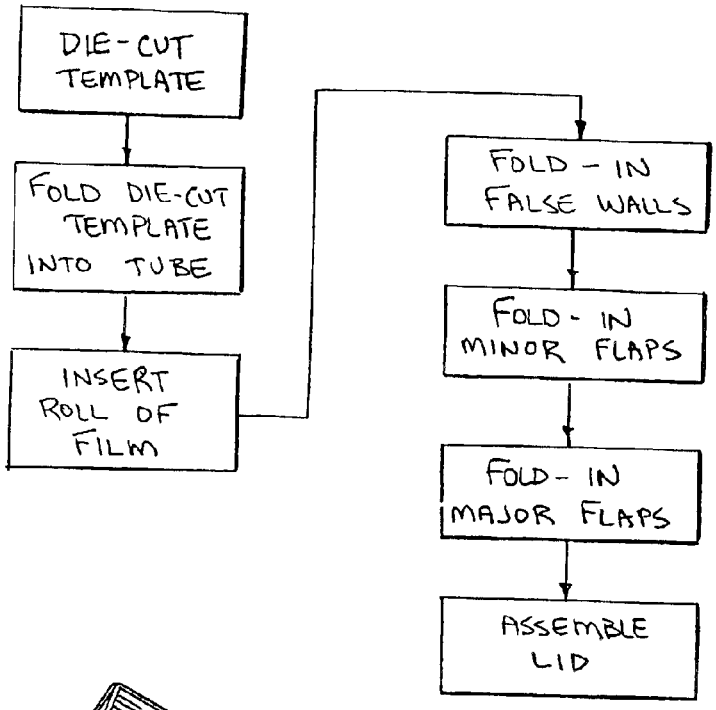
FIG. 6 is a flow chart depicting a sample sequence of steps which may be employed to construct a wound film dispenser constructed in accordance with the teachings of the invention.

In assembling wound film dispensers according to the teachings of the invention, a number of steps may be employed. One exemplary set of steps is depicted in FIG. 6 in flow chart format. As shown therein, a first step 98 may be to die-cut the blank 94 as depicted in FIG. 5. A second step 100 may be to fold the blank 94 into a tube having first and second open ends, meaning that the false wall 62, and the end flaps 80, 82, 84 and 86 are not folded inwardly and secured. The roll 30 is then inserted into the tube as indicated by a step 102. The roll 30 is preferably inserted in an automated fashion by, for example, sliding the roll along a bottom wall 34 a set distance, or until a proximity sensor, or other form of position sensor, is triggered.

Figure 2:
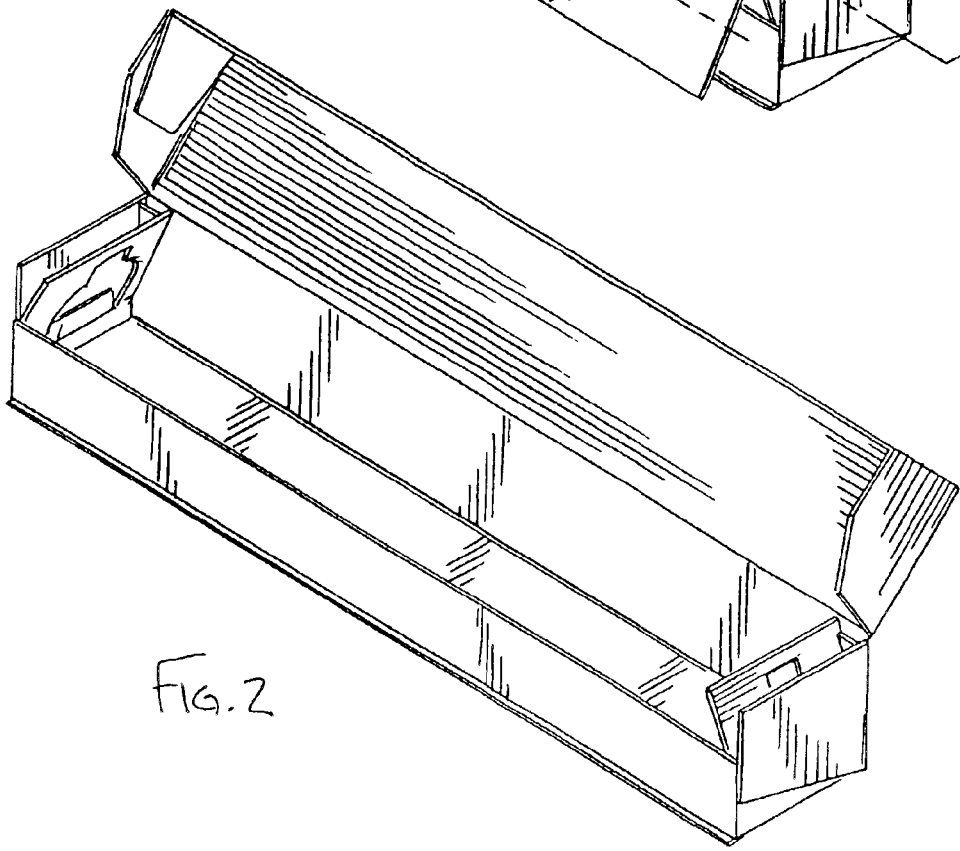
FIG. 2 is an isometric view of the wound film dispenser of FIG. 1, but without a roll of wound film disposed therein.

Once the roll 30 is inserted, the assembly of the end walls 40, 42 is commenced by folding the brace 64 normal to the false wall 62 and folding the false wall 62 into the tube, as indicated by a step 104. In so doing, the ends 58, 60 of the core 52 are captured, thereby retaining the roll 30 within the dispenser 20. The minor flap 82 is then folded inwardly, as indicated in a step 106, to be adjacent the false wall 62. The minor flap 82 may be adhered to the false wall 62 once folded. The base 22 is completed upon folding of the major flap 80, as indicated in a step 108. The major flap 80 is adhered parallel to the minor flap 82 creating the ends 40, 42. As illustrated in FIGS. 2 and 3, when the dispenser 20 is assembled, the brace 64 engages the ends 40, 42, biasing the false walls 62 angularly inward.

The dispenser 20 is completed upon folding of minor flap 86 and major flap 84 of the lid 24, as indicated in a step 110. More specifically, as shown best in FIG. 2, the minor flap 86 is folded normal to the lid top wall 44, and major flap 84 is then folded parallel thereto and adhered into position. In so doing, the dispenser 20 is completed, substantially enclosing the roll 30 and protecting the roll 30 from contamination. Even after opening, i.e., removal of the tear strip 88, the lid 24 provides closed ends cooperating with the closed ends of the base 22 to substantially enclose the roll 30.

Figure 7:
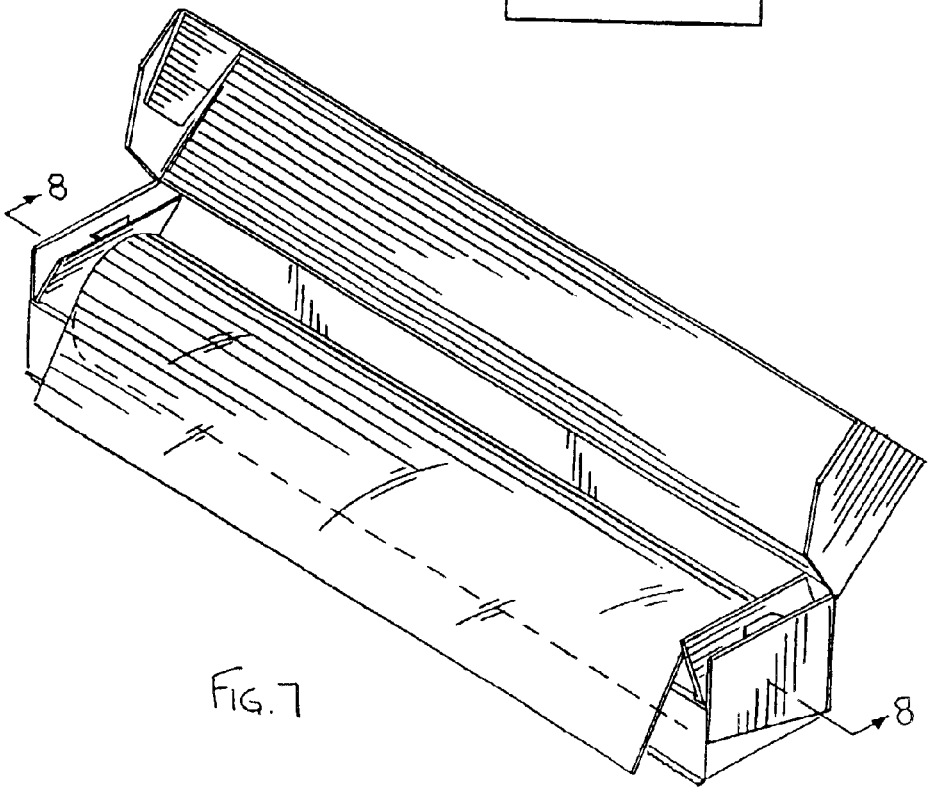
FIG. 7 is an isometric view of an alternative roll film dispenser constructed in accordance with the teachings of the invention and shown with a roll of wound film disposed therein.
Figure 8:
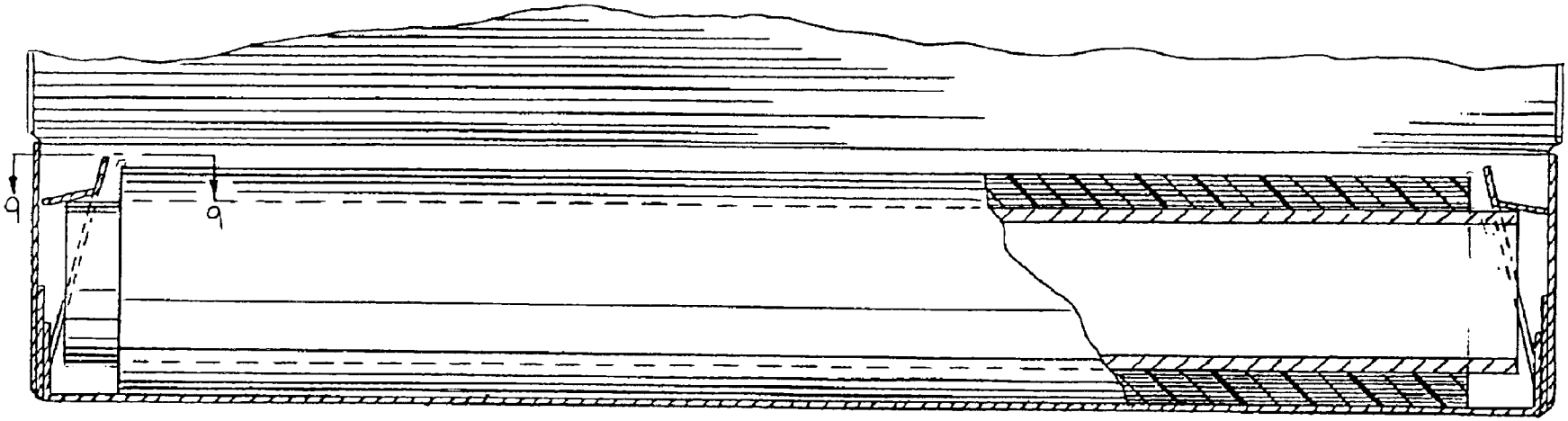
FIG. 8 is a longitudinal sectional view of the dispenser of FIG. 8 taken along line 8—8 of FIG. 7, with the roll of film shown in partially cut-away form.
Figure 9:
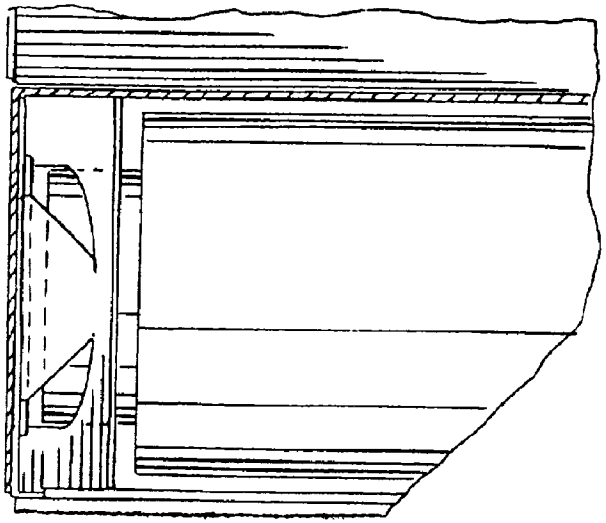
FIG. 9 is an enlarged cut-away top view of the dispenser of FIG. 8.
Figure 10:
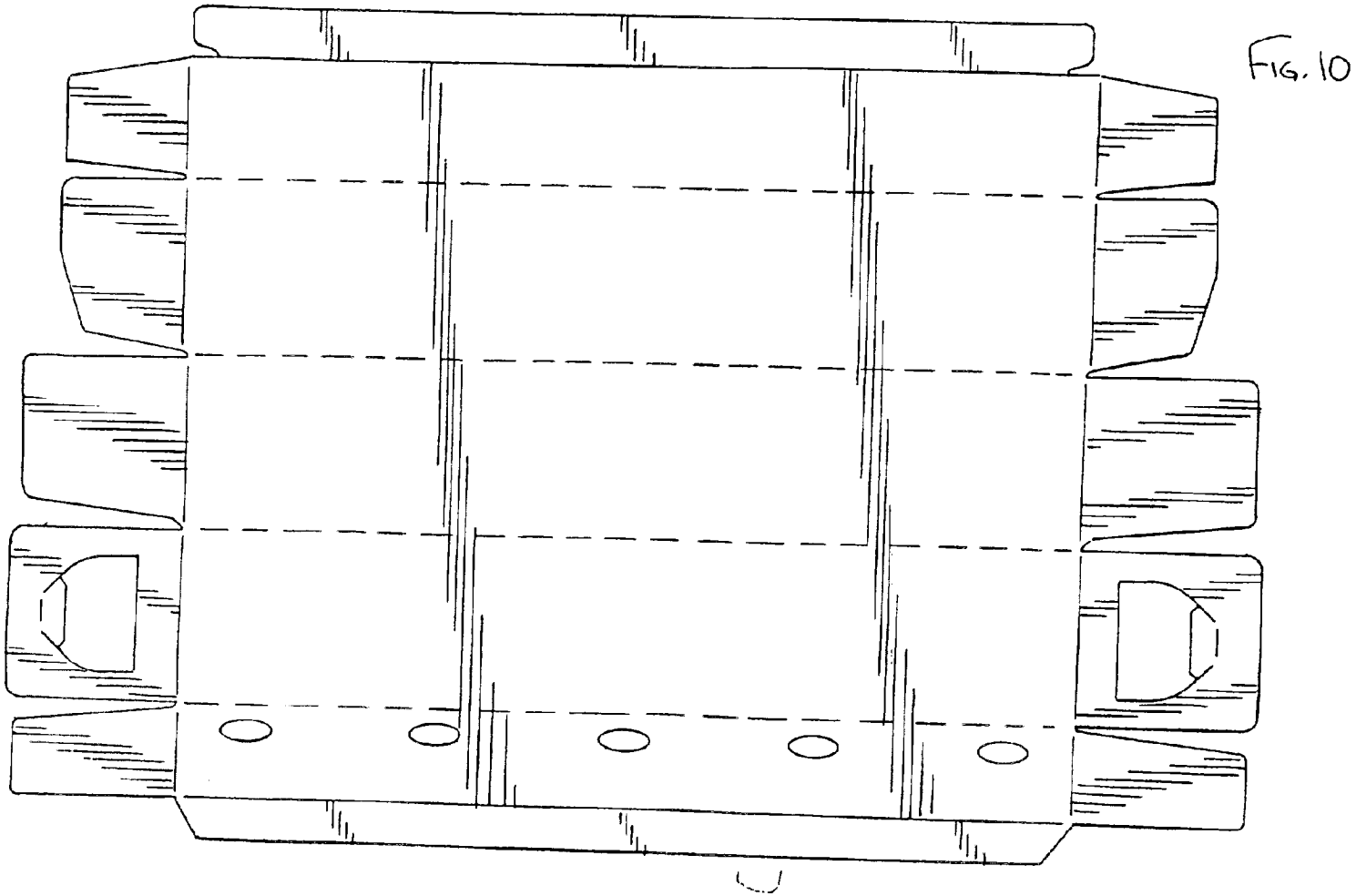
FIG. 10 is a plan view of a die-cut blank prior to folding according to the teachings of the invention.

Referring now to FIGS. 7–10, an alternative embodiment of a wound film dispenser constructed in accordance with the teachings of the invention is depicted. Wherein like elements are employed, like reference numerals are used. One difference with respect to the alternative embodiment of FIGS. 6 and 7 is provided in the form of the brace. As depicted therein, the brace 97 of the alternative embodiment extends from a top edge 98 of the aperture 76. The brace 97 is substantially polygonal in shape including a front edge 100, back edge 102, and first and second side edge 104, 106. The brace 64 is folded away from the false wall 62 so as to allow the front edge 100 to directly engage the ends 40, 42.

It is to be understood, that in still further embodiments, the brace 97 can be differently positioned. For example, the brace 97 may extend from one of the sides of the aperture 76. Moreover, the brace may extend inwardly from the minor flap 82 so as to push the false wall 62 inwardly.

From the foregoing, one of ordinary skill in the art will recognize that the teachings of the present invention can be employed to construct a wound film dispenser for wraps and the like, having improved manufacturability and dispensing capability, with reduced material requirements as well.

What is claimed is:

1. A wound film dispenser, comprising:

a base having bottom, front, back, and first and second ends walls, and an open top defining an interior channel;

a lid hingedly attached to the base, the lid including a lid wall opposite the bottom wall of the base;

retention walls mounted in the first and second ends of the base, the retention walls attached to the bottom wall and extending at an angle from the bottom wall into the interior channel, the retention walls each including an aperture adapted to receive an end of a roll of wound film, the retention walls being oblique to each of the bottom, front, back walls, and the first and second end walls; and a brace extending from each retention wall and positioned to engage the end walls, thereby angling the retention walls into the interior channel, each brace being a side flap separated by a fold line from the retention wall, the fold line being generally perpendicular to the bottom wall, the brace having a side edge tapered away from the fold line at an angle corresponding to an angle at which the retention walls extend away from the end walls.

2. The wound film dispenser of claim 1, wherein the base, lid, and retention walls are manufactured from a unitary piece of material.

3. The wound film dispenser of claim 2, wherein the material is die-cut single ply chipboard.

4. The wound film dispenser of claim 1, wherein the side flap is wedge-shaped.

5. The wound film dispenser of claim 1, wherein the end walls include a major flap hinged to the back wall of the base and a minor flap hinged to the front wall, the retention wall being proximate the minor flap.

6. The wound film dispenser of claim 1, wherein the retention wall aperture is semi-circular in shape.

7. The wound film dispenser of claim 1, wherein the flap extends from a side of the retention wall proximate the back wall of the base.

8. The wound film dispenser of claim 1, wherein the flap extends from a top edge of the retention wall aperture.

* * * * *